United States Patent [19]

Cox

[11] 4,201,138

[45] May 6, 1980

[54] CORNERBOARD FOR PALLETS

[76] Inventor: Clayton E. Cox, 1371 Eureka Canyon Rd., Watsonville, Calif. 95076

[21] Appl. No.: 948,546

[22] Filed: Oct. 4, 1978

[51] Int. Cl.[2] ..... B65D 19/06; B65D 85/00

[52] U.S. Cl. ..... 108/55.1; 206/453; 206/586; 206/597

[58] Field of Search ..... 108/53.1, 53.5, 55.1, 108/55.5, 56.1, 51.1, 56.3, 57.1; 206/386, 597, 600, 453, 586, 516; 229/DIG. 1, 23 BT; 214/10.5 R, 10.5 S; 52/301, 296; 211/43, 189

[56] References Cited

U.S. PATENT DOCUMENTS

| | | | |
|---|---|---|---|
| 1,200,467 | 10/1916 | Cady | 206/453 X |
| 1,352,490 | 9/1920 | Wilkins | 211/189 X |
| 1,682,060 | 8/1928 | Banks | 211/43 |
| 1,798,753 | 3/1931 | Paque | 52/301 |
| 2,277,674 | 3/1942 | Belsinger | 206/586 X |
| 2,365,854 | 12/1944 | Albaugh | 52/300 |
| 2,512,145 | 6/1950 | Ford | 108/56.1 X |

FOREIGN PATENT DOCUMENTS

| | | | |
|---|---|---|---|
| 690391 | 7/1964 | Canada | 52/301 |
| 163980 | 7/1958 | Sweden | 206/597 |

*Primary Examiner*—William E. Lyddane

[57] ABSTRACT

An improved cornerboard for a pallet is provided wherein conventional boards are equipped with top and bottom caps which may be fabricated of a suitable hard material such as plastic or metal. The cornerboard caps of the present invention protect the ends of the cornerboards from damage and also hold them in the correct right angle alignment. Cornerboard caps may be fitted with top portions which further protect material on a pallet. In accordance with one embodiment of the invention, filler sections may be employed so that a given set of cornerboards can accept loads of different heights.

3 Claims, 4 Drawing Figures

CORNERBOARD FOR PALLETS

SUMMARY OF THE INVENTION

Many materials, such as frozen foods, are sold in relatively small cartons and in order to handle these expeditiously, they are placed on pallets. In order that the pallets can be handled and stored, it is ordinarily necessary to provide some sort of corner structure for the palleted goods to keep the goods upright and to prevent them from sliding off the pallets.

In the past, it has been universal practice to hold goods on pallets by the use of ordinary boards. Two boards are nailed together at a right angle to form a corner pair and four of such corner pairs are placed at the corners of the loaded pallet and held together with some form of strap.

The cornerboards used in the past have not been fully satisfactory, primarily in that they do not properly protect the goods of the pallet. Such boards frequently come apart and allow the goods to sag so that much merchandise is lost.

In accordance with the present invention, an improved corner structure is provided for pallets which includes caps which protect and strengthen conventional cornerboards.

In my companion application Ser. No. 907,096, filed May 15, 1978, I have described and claimed a cornerboard wherein the top element has a downwardly-extending fin which fits into a slot in a side member. In the present invention, the top and bottom members are slotted caps which fit over and protect conventional cornerboards.

The corner structures including the caps of the present invention are much stronger than conventional boards so that better protection is given to the load.

A further feature of the present invention is that the top cap, and in some instances the bottom cap as well, is provided with a member which partially fits over the load and which further protects the contents of the pallet.

Preferably, the cornerboard caps of the present invention are made of a reinforced plastic material so that they are much stronger than the corner structures used in the past. They can also be made of metal.

Other features and advantages of the invention will be brought out in the balance of this application.

DESCRIPTION OF THE PREFERRED EMBODIMENTS

Figure 1:
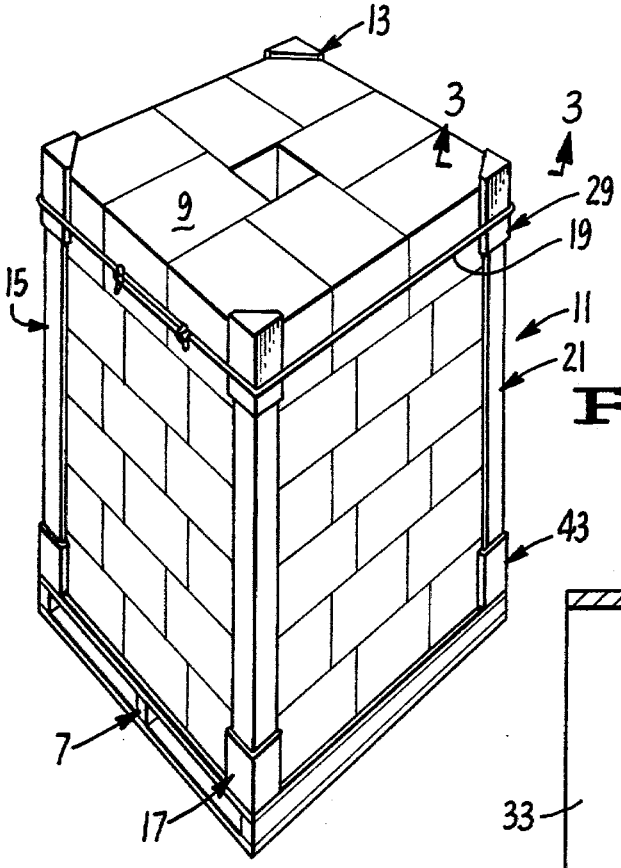
FIG. 1 is a perspective view of a loaded pallet utilizing corner structures embodying the present invention.

Referring now to the drawings by reference characters, there is shown a pallet 7 having a load of boxes 9 thereon. The boxes 9 have a rectangular configuration and have been stacked to fit the pallet 7.

In accordance with the present invention, four corner elements generally designated 11, 13, 15 and 17 are placed at the four corners of the loaded pallet and a flexible strap 19 is employed to hold the cornerboards together and maintain the pallet load in a desired configuration. Although only a single strap 19 has been shown, in many instances two or even more straps might be used around the load.

Figure 2:
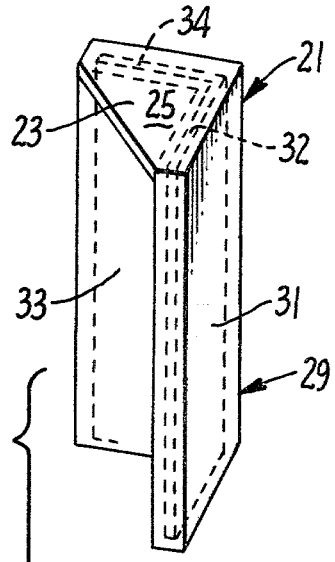
FIG. 2 is a perspective exploded view of a corner structure.
Figure 3:
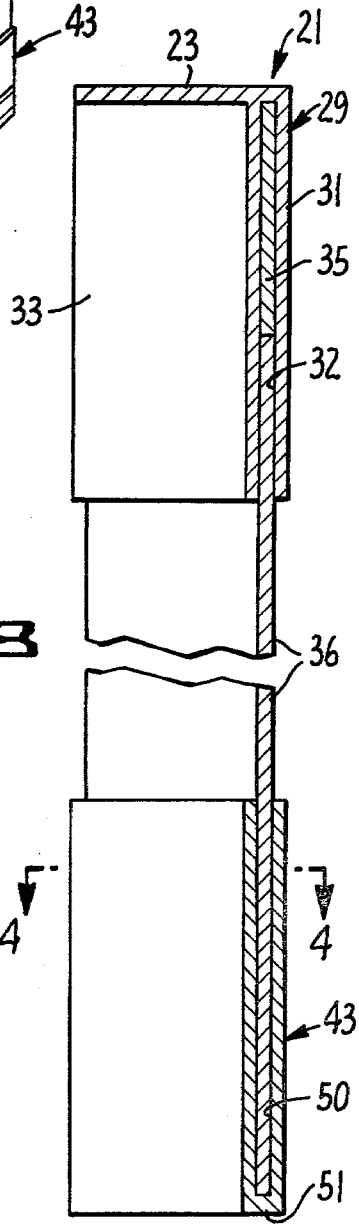
FIG. 3 is an enlarged section on the line 3—3 of FIG. 1.
Figure 4:
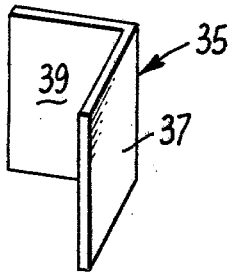
FIG. 4 is a section on the line 4—4 of FIG. 3.
Figure 4:
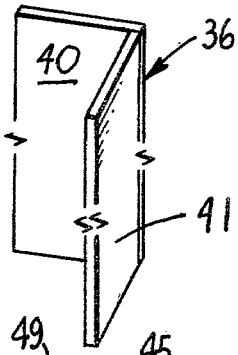
Figure 4:
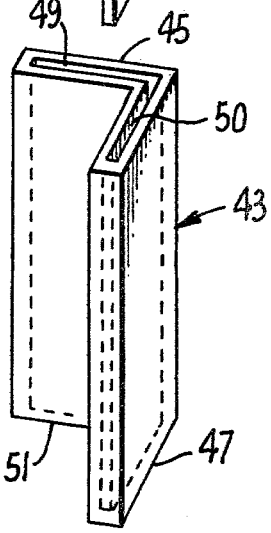
Figure 4:
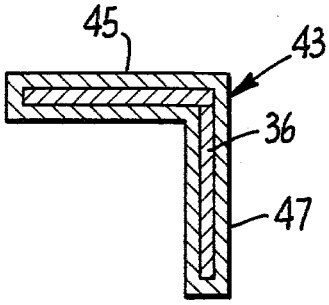

Since the four cornerboards are identical, only one will be described in detail. Thus, referring to FIGS. 2 through 4, the cornerboards included a top cap member generally designated 21. The member 21 has a top cover 23 which has a flat upper surface 25 so that the flat upper surface covers the corner of a pallet load. Extending downwardly from the cap 21 is the right angled side member 29 which includes the elements 31 and 33 which are formed at a right angle to each other. The elements 31 and 33 are formed at a right angle to each other. The elements 31 and 33 are formed of thick sections and have slots 32 and 34 therein to allow ordinary boards to enter the slots.

Below the top member 21 is an optional spacer member generally designated 35. This member has two thin walls 37 and 39 which are formed at right angles to each other and which form a snug fit in the slots 32 and 34. The cornerboard proper is designated 36 and it consists of two boards 40 and 41 which are fastened together at a right angle to each other by a conventional fastener such as nails.

Situated below spacer element 35, if used, and cornerboard 36 is the bottom member generally designated 43. This member has two walls 45 and 47 with slots 49 and 50 which are complementary to the cornerboard 36. The slots 49 and 50 terminate short of the bottom as is shown at 51. Thus, the bottom member 43 has slots opening at the top but is solid at the bottom.

One feature of the present invention is that spacer members can be used interchangeably to provide for varying heights of stacks of goods piled on the pallet. Thus, the member 35 could be longer or shorter depending on the particular height of the goods piled on the pallet. Of course, if the spacer 35 is used, it must be substantially shorter than the slot in the top member 29 so that the cornerboard proper 36 can fit into the slot for a sufficient distance to provide a strong structure. Of course, it is not always necessary to use the member 35 and the cornerboard itself can be selected of the correct length for the particular load of the pallet.

Many variations can be made in the exact structure shown without departing from the spirit of this invention.

I claim

1. A corner structure for a pallet comprising in combination:

a. a top member, said member having a top cap adapted to extend over the corner of a loaded pallet and having a top side member extending downward from the top cap, said top side member being composed of two flat elements held at right angles to each other and each having a slot therein, each said slot being open only at the bottom of said flat elements and joined at the intersection of said flat elements;

b. a middle side member, said middle side member having two thin elements maintained in a right angle configuration to fit into the slots in said top side member, and c. a bottom member of substantially the same configuration as the top member having flat side members held at right angles to each other with enclosed slots to receive the middle side member, said slots being open only at the top of said flat side members and joined at the intersection of said flat side members.

2. The corner structure of claim 1 having in addition a second middle side spacer member fitting into one of said slots and abutting on and forming an extension of said middle side member of paragraph b.

3. The structure of claims 1 or 2 wherein the top and bottom members are molded of plastic.

* * * * *